United States Patent [19]

Suzuki

[11] 4,049,080

[45] Sept. 20, 1977

[54] ESCAPE DEVICE FOR A MULTI-STOREY BUILDING

[76] Inventor: Yoshio Suzuki, 529 Futago, Takatsu, Kawasaki, Kanagawa, Japan

[21] Appl. No.: 676,694

[22] Filed: Apr. 14, 1976

[51] Int. Cl.[2] ..... A62B 1/20

[52] U.S. Cl. ..... 182/48; 193/11

[58] Field of Search ..... 182/48, 49, 82; 248/55; 193/11, 12, 27

[56] References Cited

U.S. PATENT DOCUMENTS

| | | | |
|---|---|---|---|
| 629,591 | 7/1899 | Pardee | 193/12 |
| 937,722 | 10/1909 | Schweimler | 193/27 |
| 1,092,662 | 4/1914 | Ottignon | 193/27 |
| 2,991,807 | 7/1961 | Turner | 248/55 |
| 3,910,377 | 10/1975 | Zamorski | 182/48 |

*Primary Examiner*—Reinaldo P. Machado
*Attorney, Agent, or Firm*—Beaman & Beaman

[57] ABSTRACT

An escape device for a multi-storey building having emergency exits in the outer side wall of each of the storeys of said building comprising a plurality of support brackets secured to said outer side walls and a downwardly inclined meandering main body including a plurality of straight sections integrally connected together by means of outwardly arcuated corner sections and supported by said support brackets to provide a meandering chute, alternate straight sections of said main body being provided adjacent to one end thereof and adjacent to said emergency exits with evacuation openings.

6 Claims, 6 Drawing Figures

ESCAPE DEVICE FOR A MULTI-STOREY BUILDING

BACKGROUND OF THE INVENTION

This invention relates to an escape device to be used on a multi-storey building and more particularly, to an escape device to be installed on a multi-storey building whereby when a fire or other disasters occur in the building, people who are present within the building can promptly and safely evacuate from the building through the escape device to a safer place without being terror-stricken.

Presently, when a fire or other disasters occur in a multi-storey building, in order to safely evacuate people present within the building, jumping-off mats, canvas evacuation ducts and fire ladders have been commonly employed. However, these prior art emergency escape devices encounter difficulties in evacuating a great number of people from the building in a brief space of time and in case of such emergency, people usually tend to lose their composure and rush to the escape devices and therefore, there exist potential hazards that the evacuating people may lose their footing and so on resulting in death or serious injuries. In spite of the recent tendency that an increasing number of multi-storey buildings are being built and the newly built buildings increase their height year after year, development of the art of escape devices has not kept up with the increase in building height. Under the situation,, developing of improved escape devices which can be satisfactorily used in connection with multi-storey buildings has been required.

SUMMARY OF THE INVENTION

Therefore, the present invention is to eliminate the disadvantages inherent in the prior art escape devices referred to hereinabove and ensure safe evacuation of people from a multi-storey building in case of a fire and other disasters by supporting a main body in the form of a meandering chute by support brackets which are to be simply secured to the outer side wall of a building where emergency exits are provided and enabling people within the building to simply and safely evacuate through the utilization of the principle of a meandering chute.

One principal object of the present invention is to provide a novel and improved escape device which enables many people to evacuate safely and simply from a multi-storey building in a brief space of time without being terror-stricken which is inevitable when the people evacuate by the employment of jumping-off mats, canvas evacuation ducts and fire ladders.

Another object of the present invention is to provide a novel and improved escape device which is most suitably employed for a multi-storey building when a fire or other disasters occur in the building.

For attaining the above-mentioned objects of the present invention, according to the present invention there has been provided an escape device which comprises the main body including a plurality of straight sections integrally connected together by means of outwardly arcuated corner sections to provide a meandering chute construction to the main body, support brackets secured to the outer side wall of each of the storeys of a multi-storey building and supporting the main body sections, evacuation openings provided adjacent to one end of the lower ends of alternate ones of the main body straight sections and positioned adjacent to emergency exists in the storeys, and a shock absorbing means provided at the lower end of the lowermost main body straight section.

The above and other objects, features and attendant advantages of the present invention will be more readily apparent to those skilled in the art from a reading of the following detailed description in conjunction with the accompanying drawing which shows one preferred embodiment of the present invention for illustration purpose only, but not for limiting the scope of the same in any way.

BRIEF DESCRIPTION OF THE DRAWING

The accompanying drawing shows one preferred embodiment of emergency escape device constructed in accordance with the present invention wherein.

PREFERRED EMBODIMENT OF THE INVENTION

Figure 4:
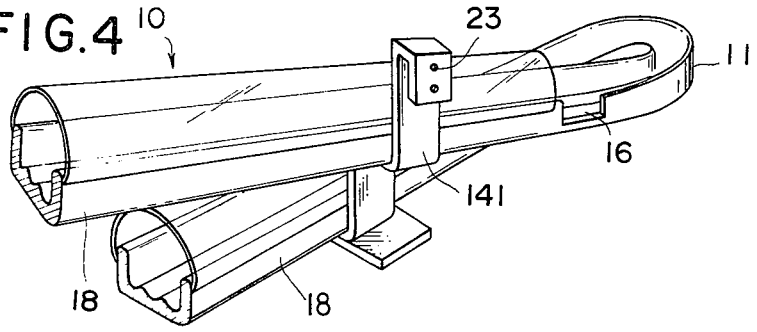
FIG. 4 is a fragmentary perspective view showing adjacent two straight sections of said main body as being connected together by one arcuated corner section and supported by one of said support frame of the escape device.
Figure 1:
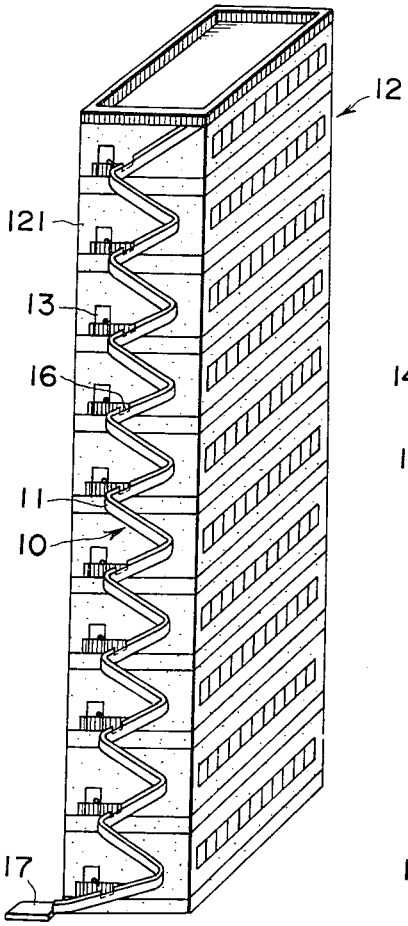
FIG. 1 is a schematic perspective view of a multi-storey building on which said emergency escape device of the invention is installed.
Figure 2:
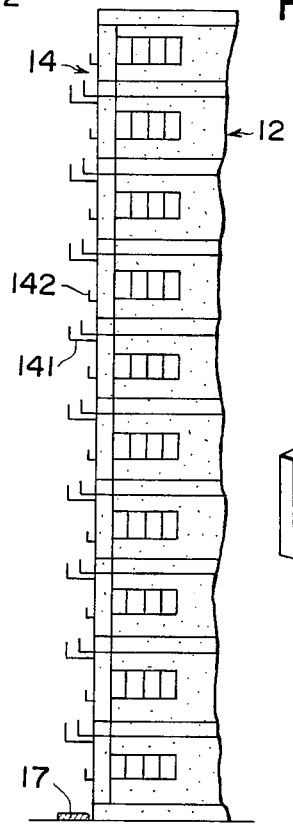
FIG. 2 is a schematic fragmentary front elevational view of said multi-storey building showing the arrangement in which the support brackets of said escape device are secured to said building.
Figure 6:
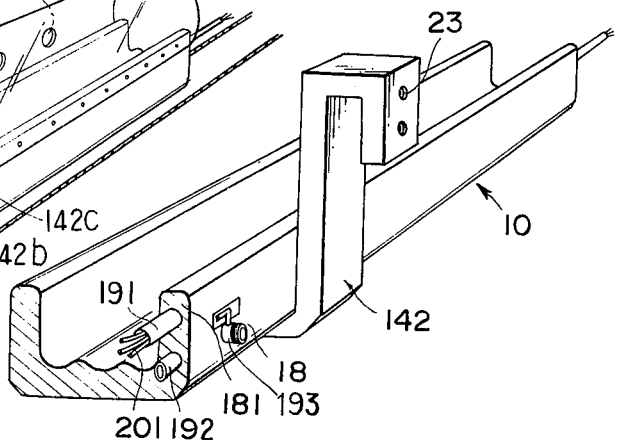
FIG. 6 is a fragmentary perspective view on the same scale as that of FIG. 5 showing one of said straight sections of the main body of the escape device as being supported substantially in the center of the section and with the covering roof removed therefrom.

The present invention will be now described referring to the accompanying drawing which shows one preferred embodiment of an emergency escape device of the present invention for a multi-storey building and more particularly, to FIGS. 1, 4 and 6 thereof in which reference numberal 10 generally denotes the downwardly inclined unitary main body of the escape device and as seen in FIG. 1, the main body 10 is in the form of a meandering chute comprising a plurality of straight sections integrally connected together at the adjacent ends thereof by means of outwardly arcuated corner sections 11 and having a substantially U-shaped cross-section. The adjacent upper and lower main body straight sections extend substantially at right angles to each other and also as seen in FIG. 1, the main body is supported by means of support brackets 14 secured to the side wall 121 of each of the storeys of a multi-storey building 12 where an emergency exit 13 is provided. In the embodiment as shown, the lower end of each of the odd number main body straight sections (in the order counted from the topmost section) is positioned adjacent to the associated exit 13 in each of the storeys of the building 12 for the purpose to be described hereinafter.

The open top of the main body 10 is covered by a transparent outwardly or upwardly arcuated semi-circular cross-section roof 15 which is detachably secured to the main body by means of suitable conventional fastening means such as screws (not shown) and meanders in conformity with the meandering configuration of the main body 10 and the roof is adapted to preclude fire flames and smoke from flowing into the escape device when a fire occurs in the building. The lower end of each of the odd number main body straight sections where the body section is connected to the adjacent corner section 11 is provided with an evacuation opening 16 which has a size greater than the exit 13 and through which people coming out of the adjacent exit 13 can enter the main body 10 in case of emergency such as occurrence of a fire in the building. A cushion or shock absorption means 17 such as sand, a mat or other shock absorption materials can be provided at the exit end or lower end of the lowermost main body straight section to protect evacuating people against possible injury when they slide down onto the ground. As more clearly shown in FIGS. 3, 4 and 6, the bottom wall or the center portion of the U-shaped cross-section main body 10 has a corrugated cross-section to accelerate the sliding-down speed of evacuating people within the main body 10 and one side wall or the right-hand side wall 18 of the main body is provided adjacent to the upper edge 181 with a conduit 191 embedded in and extending through the side wall 18 in the longitudinal direction of the side wall. An emergency communication line such as a telephone line, an interphone line and an illumination line 201 extends through the conduit 191. Also provided in the side wall 18 of the main body 10 below and in parallel to the conduit 191 is a water supply pipe 192 which has a plurality of discharge nozzles 193 (only one nozzle is shown) at a suitable spaced positions in the longitudinal direction of the pipe extending laterally and outwardly of the pipe through the side wall 18.

A plurality of switches 21 (only one switch is shown) are provided on the inner surface of the transparent roof f15 at suitably spaced positions in the longitudinal direction of the roof and electrically connected to the emergency lines 201 whereby evacuating people in the main body 10 can communicate with persons in each of the storeys of the building to be guided in their evacuation. Also, provided in the roof 15 in suitably spaced positions in the longitudinal direction of the roof are a plurality of through air holes 22.

Figure 5:
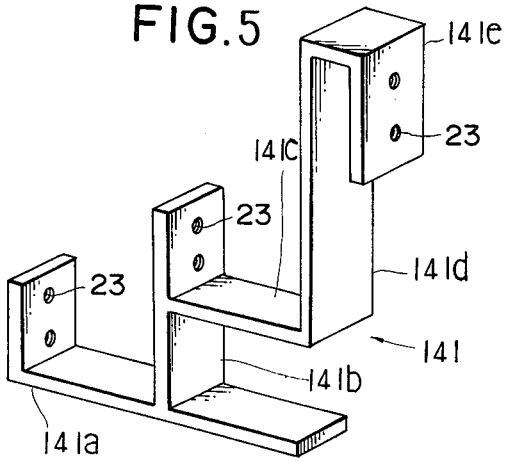
FIG. 5 is a fragmentary perspective view on a further enlarged scale of one of said support frames of the escape device which is employed for supporting two adjacent straight sections of said main body.

The support brackets 14 for supporting the straight sections of the main body 10 are adapted to be secured to each of the storeys of the building 12 and include first support brackets 141 each adapted to support adjacent two upper and lower straight sections of the main body at the ends of the sections adjacent to the associated corner section 11 and second support brackets 142 each adapted to support the associated main body straight section substantially in the center of the section. The first and second brackets 141, 142 are each provided with a plurality of threaded holes 23 for receiving screws or bolts (not shown). As more clearly shown in FIG. 5, the first support brackets 141 have a multi-L-shaped construction including a first or lowermost L-shaped section 141*a* having the longer horizontal leg portion and the shorter upright leg portion, a second L-shaped section 141*b* having the shorter leg portion which is formed by one or the outer half of the longer horizontal leg portion of the first L-shaped section and the longer upright portion extending uprightly from the center of the longer leg portion of the first L-shaped section, a third L-shaped section 141*c* having the shorter upright leg portion which is formed by one or the upper half of the upright leg portion of the second L-shaped section and the longer horizontal leg portion extending horizontally from the center of the longer upright leg portion of the second L-shaped section, a fourth L-shaped section 141*d* having the shorter leg portion which is formed by the longer horizontal leg portion of the third L-shaped section and the longer upright leg portion extending uprightly from the free end of the shorter horizontal leg portion of the associated L-shaped section and a fifth or uppermost L-shaped section 141*e* having the shorter horizontal leg portion connected at one end to the upper end of the longer upright leg portion of the fourth L-shaped section and the longer depending leg portion extending downwardly from the other end of the horizontal leg portion of the associated shorter leg portion. The second support bracket 142 (see FIGS. 3 and 4) also has a multi-L-shaped construction, but is simpler than that of the first support frame 141. The second support frame 142 includes a first L-shaped section 142*a* having the longer upright leg portion and the shorter horizontal leg portion, a second L-shaped 142*b* section having the shorter horizontal leg portion which is common to the shorter leg portion of the first L-shaped section and the longer upright leg portion extending uprightly from the other end of the horizontal leg portion and a third L-shaped section 142*c* having the shorter horizontal leg portion connected at one end to the upper end of the upright leg portion of the second L-shaped section and the longer depending leg portion depending from the other end of the horizontal leg portion.

As shown in FIG. 4, the first L-shaped section 141*a* and the longer upright leg portion of the second leg section 141*b* in the first support bracket 141 cooperate with each other to define an opening fro receiving the lower straight section of the adjacent two upper and lower main body straight sections adjacent to one end of the straight section and similarly, the third L-shaped section and the fourth L-shaped section 142*d* in the same support bracket 141 cooperate with each other to define an opening for receiving the upper straight section of the two adjacent upper and lower main body straight sections adjacent to one end of the straight section.

Figure 3:
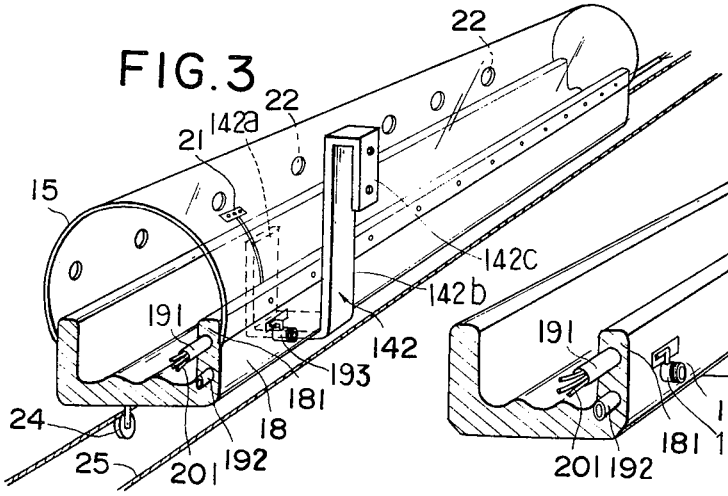
FIG. 3 is a fragmentary perspective view on an enlarged scale of one straight section of the main body and its associated parts of said escape device.

Similarly, as shown in FIGS. 3 and 6, the first L-shaped section 142*a* and second L-shaped section 142*b* in the second support bracket 142 cooperate with each other to define an opening for receiving each of the main body straight sections substantially in the center of the associated section.

The undersurface of each of the main body straight sections is provided with pulleys 24 in two parallel rows in suitably spaced positions in the longitudinal direction of the associated section and rope 25 is guided over each row of pulleys and the purpose of the pulley and rope arrangement 24, 25 is that in case of occurrence of a fire or other disasters, important documents in packages or bundles taken out of the windows in the building storeys are hung on and transported down along the ropes and/or fire men and rescue party members go up and down the building storeys along the ropes by hanging on a suitable means to go in and out of the storeys. The ropes 25 are normally driven by an electric motor (not shown), but in case of interruption of power supply, the ropes can be manually operated.

Since the escape device in the form of a meandering chute of the present invention is adapted to be installed on the outer side wall of a multi-storey building, the escape device can be easily installed on multi-storey buildings having a relatively small number of or narrow evacuation pathways as often seen in Japan. And since the meandering main body comprises a number of straight sections integrally connected together by means of arcuated corner sections and simply supported by support brackets which are in turn suitably secured to each of the storeys of a building, the escape device is simple in construction and inexpensive to install. In addition, since the alternate main body straight sections are provided adjacent to the lower ends with evacuation openings greater than the emergency exits in the storeys in the building, evacuating people coming out of the exits can easily and freely enter the escape device. Still furthermore, even when evacuating people slide down through the escape device from the uppermost storey of a multi-storey building, since the main body of the device is a meandering configuration, the evacuating people will be relatively less terror-stricken.

Especially, when the escape device is installed on kindergartens and primary schools where many infants and juveniles are housed, they will become accustomed to use the escape device because they play on the device everyday in the same manner as they do on conventional meandering chutes and even in case of occurrence of a fire or other disasters, they can evacuate safely and easily from the buildings through the escape device to a safer place without being terror-stricken. When the escape device is installed on facilities for handicaped people, the handicaped people can safely and easily evacuate from the facilities in case of emergency.

While only one embodiment of the invention has been shown and described in detail, it will be understood that the same is for illustration purpose only and not to be taken as a definition of the invention.

What is claimed is:

1. An escape device for a multi-storey building having emergency exits in the outer side wall of each of the storeys of said building, said escape device comprising a plurality of support brackets secured to said outer side wall of the building storeys, a downwardly inclined main body including a plurality of straight sections connected integrally together by means of outwardly curved corner sections to provide a meandering chute construction to said main body and supported by said support brackets, evacuation openings provided adjacent the lower ends of alternate straight sections of said plurality of straight sections and positioned adjacent said emergency exits, a plurality of pulleys mounted on the bottom of said main body in two parallel rows at a plurality of spaced positions along the length of the main body, ropes guided over said rows of pulleys, and a shock absorbing means provided at the lower end of the lowermost straight section of said plurality of straight sections.

2. The escape device for a multi-storey building as set forth in claim 1, in which the bottom wall of said main body has a corrugated cross-section.

3. An escape device for a multi-storey building having emergency exits in the outer side wall of each of the storeys of said building, said escape device comprising a plurality of support brackets secured to said outer side wall of the building storeys, a downwardly inclined main body including a plurality of straight sections connected integrally together by means of outwardly curved corner sections to provide a meandering chute construction to said main body and supported by said support brackets, evacuation openings provided adjacent the lower ends of alternate straight sections of said plurality of straight sections and positioned adjacent said emergency exits, said main body having side walls, a plurality of parallel and spaced conduits embedded in a body side wall and extending in the longitudinal direction thereof, emergency communication lines such as a telephone line, an interphone line and an illumination line extending through at least one of said conduits, and a water pipe extending through another conduit of said plurality of conduits, and a shock-absorbing means provided at the lower end of the lowermost straight section of said plurality of straight sections.

4. In an escape device as in claim 3, a transparent roof of an outwardly arcuate semicircular cross section detachably secured to the top of said main body, and a plurality of spaced electrical switches mounted upon the inner side of said roof electrically connected to said emergency communication lines.

5. An escape device for a mult-storey building having emergency exits in the outer side wall of each of the storeys of said building, said escape device comprising a plurality of support brackets secured to said outer side wall of the building storeys, a downwardly inclined main body including a plurality of straight sections connected integrally together by means of outwardly curved corner sections to provide a meandering chute construction to said mean body and supported by said support brackets, evacuation openings provided adjacent the lower ends of alternate straight sections of said plurality of straight sections and positioned adjacent said emergency exits, said support brackets including a plurality of first support frames for supporting adjacent two straight sections of said main body adjacent one end of said sections and a plurality of second support brackets each for supporting each one of said straight sections of the main body substantially in the center of the section, said first support bracket having a multi-L-shaped construction including a first L-shaped section having a longer horizontal leg portion and a shorter upright leg portion, a second L-shaped section having the longer upright leg portion extending uprightly from the center of said longer leg portion of the first L-shaped section and the shorter horizontal leg portion formed by one half of said first section longer horizontal leg portion, a third L-shaped section having the longer horizontal leg portion extending horizontally from the center of said longer upright leg portion of the second L-shaped section and the shorter upright leg portion formed by the upper half of said upright leg portion of the second L-shaped section, a fourth L-shaped section having the longer upright leg portion extending uprightly from the outer end of said longer horizontal leg portion of the third L-shaped section and the horizontal shorter leg portion formed by said longer horizontal leg portion of the third L-shaped section, and a fifth L-shaped section having the shorter horizontal leg portion extending horizontally from the upper end of said longer upright leg portion of the fourth L-shaped section and the longer depending leg portion depending from the other end of said shorter horizontal leg portion of the fourth L-shaped section, said first and second L-shaped sections defining an opening for receiving the lower straight section of adjacent two upper and lower main body straight sections adjacent one end of the lower straight section and said third and fourth L-shaped sections defining an opening for receiving the upper straight sections of said adjacent two upper and lower main body straight sections adjacent one end of the upper straight section, and a shock absorbing means provided at the lower end of the lowermost straight section of said plurality of straight sections.

6. An escape device for a multi-storey building having emergency exits in the outer side wall of each of the storeys of said building, said escape device comprising a plurality of support brackets secured to said outer side wall of the building storeys, a downwardly inclined main body including a plurality of straight sections connected integrally together by means of outwardly curved corner sections to provide a meandering chute construction to said main body and supported by said support brackets, evacuation openings provided adjacent the lower ends of alternate straight sections of said plurality of straight sections and positioned adjacent said emergency exits, said support brackets including a plurality of first support frames for supporting adjacent two straight sections of said main body adjacent one end of said sections and a plurality of second support brackets each for supporting each one of said straight sections of the main body substantially in the center of the section, said second support bracket having a multi-L-shaped construction including a first L-shaped section having a longer upright leg portion and a shorter horizontal leg portion, a second L-shaped section having a longer upright leg portion and a shorter horizontal leg portion which is common to said shorter horizontal leg portion of the first L-shaped section and a third L-shaped section having the shorter horizonal leg portion connected at one end to the upper end of said longer upright leg portion of the second L-shaped section and the longer depending leg portion depending from the other end of said shorter horizontal leg portion of the third L-shaped section, said first and second L-shaped section defining an opening for receiving the main body straight sections substantially in the center thereof, and a shock absorbing means provided at the lower end of the lowermost straight section of said plurality of straight sections.

* * * * *